US006044785A

United States Patent [19]

Crane

[11] Patent Number: 6,044,785

[45] Date of Patent: Apr. 4, 2000

[54] SAIL BANDING DEVICE

[76] Inventor: Mark A. Crane, 300 E. Coast Hwy. #61, Newport Beach, Calif. 92260

[21] Appl. No.: 09/213,123

[22] Filed: Dec. 17, 1998

[51] Int. Cl.[7] ..... B63H 9/04

[52] U.S. Cl. ..... 114/108; 114/104; 114/102.15

[58] Field of Search ..... 114/102.1, 102.15, 114/104, 105, 108

[56] References Cited

U.S. PATENT DOCUMENTS 4,280,431 7/1981 Sofen ..... 114/105

4,347,799 9/1982 Moriarty ..... 114/105

4,354,444 10/1982 puretic ..... 114/105

*Primary Examiner*—Jesus D. Sotelo

[57] ABSTRACT

A sail banding device for preventing a furled sail, in particular a spinnaker, from filling until the sail is fully hoisted. The sail banding device includes a pair of flexible elongate anchor straps coupled together. The anchor straps each have a plurality of flexible binding straps coupled thereto. Each of the binding straps is looped around the associated anchor strap in a generally U-shaped configuration such that the ends of each binding strap outwardly extends in a generally common direction from the associated anchor strap. The ends of each binding strap is detachably attached together.

7 Claims, 2 Drawing Sheets

SAIL BANDING DEVICE

BACKGROUND OF THE INVENTION

1. Field of the Invention

The present invention relates to sail banding devices and more particularly pertains to a new sail banding device for preventing a furled sail, in particular a spinnaker, from filling until the sail is fully hoisted.

1. Description of the Prior Art

The use of sail banding devices is known in the prior art. More specifically, sail banding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,861,343 by Fretwell, Jr.; U.S. Pat. No. 4,262,617 by Svensson; U.S. Pat. No. 4,270,477 by Fretwell, Jr.; U.S. Pat. No. 5,423,292 by Hall; U.S. Pat. No. 3,310,018 by Roberts, jr. et al.; and U.S. Pat. No. 2,595,110 by Steube et al.

While these devices fulfill their respective, particular objectives and requirements, the aforementioned patents do not disclose a new sail banding device. The inventive device includes a pair of flexible elongate anchor straps coupled together. The anchor straps each have a plurality of flexible binding straps coupled thereto. Each of the binding straps is looped around the associated anchor strap in a generally U-shaped configuration such that the ends of each binding strap outwardly extends in a generally common direction from the associated anchor strap. The ends of each binding strap is detachably attached together.

In these respects, the sail banding device according to the present invention substantially departs from the conventional concepts and designs of the prior art, and in so doing provides an apparatus primarily developed for the purpose of preventing a furled sail, in particular a spinnaker, from filling until the sail is fully hoisted.

SUMMARY OF THE INVENTION

In view of the foregoing disadvantages inherent in the known types of sail banding devices now present in the prior art, the present invention provides a new sail banding device construction wherein the same can be utilized for preventing a furled sail, in particular a spinnaker, from filling until the sail is fully hoisted.

The general purpose of the present invention, which will be described subsequently in greater detail, is to provide a new sail banding device apparatus and method which has many of the advantages of the sail banding devices mentioned heretofore and many novel features that result in a new sail banding device which is not anticipated, rendered obvious, suggested, or even implied by any of the prior art sail banding devices, either alone or in any combination thereof.

To attain this, the present invention generally comprises a pair of flexible elongate anchor straps coupled together. The anchor straps each have a plurality of flexible binding straps coupled thereto. Each of the binding straps is looped around the associated anchor strap in a generally U-shaped configuration such that the ends of each binding strap outwardly extends in a generally common direction from the associated anchor strap. The ends of each binding strap is detachably attached together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is imeasured by the claims, nor is it intended to be limiting as to the scope of the invention in any way.

It is therefore an object of the present invention to provide a new sail banding device apparatus and method which has many of the advantages of the sail banding devices mentioned heretofore and many novel features that result in a new sail banding device which is not anticipated, rendered obvious, suggested, or even implied by any of the prior art sail banding devices, either alone or in any combination thereof.

It is another object of the present invention to provide a new sail banding device which may be easily and efficiently manufactured and marketed.

It is a further object of the present invention to provide a new sail banding device which is of a durable and reliable construction.

An even further object of the present invention is to provide a new sail banding device which is susceptible of a low cost of manufacture with regard to both materials and labor, and which accordingly is then susceptible of low prices of sale to the consuming public, thereby making such sail banding device economically available to the buying public.

Still yet another object of the present invention is to provide a new sail banding device which provides in the apparatuses and methods of the prior art some of the advantages thereof, while simultaneously overcoming some of the disadvantages normally associated therewith.

Still another object of the present invention is to provide a new sail banding device for preventing a furled sail, in particular a spinnaker, from filling until the sail is fully hoisted.

Yet another object of the present invention is to provide a new sail banding device which includes a pair of flexible elongate anchor straps coupled together. The anchor straps each have a plurality of flexible binding straps coupled thereto. Each of the binding straps is looped around the associated anchor strap in a generally U-shaped configuration such that the ends of each binding strap outwardly extends in a generally common direction from the associated anchor strap. The ends of each binding strap is detachably attached together.

Still yet another object of the present invention is to provide a new sail banding device that replaces the conventional method of keeping a spinnaker from unfurling by looping rubber bands therearound.

Even still another object of the present invention is to provide a new sail banding device that has adjustably positionable straps to fit various sized sails and to permit repositioning to adjust to conform to changing conditions when sailing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
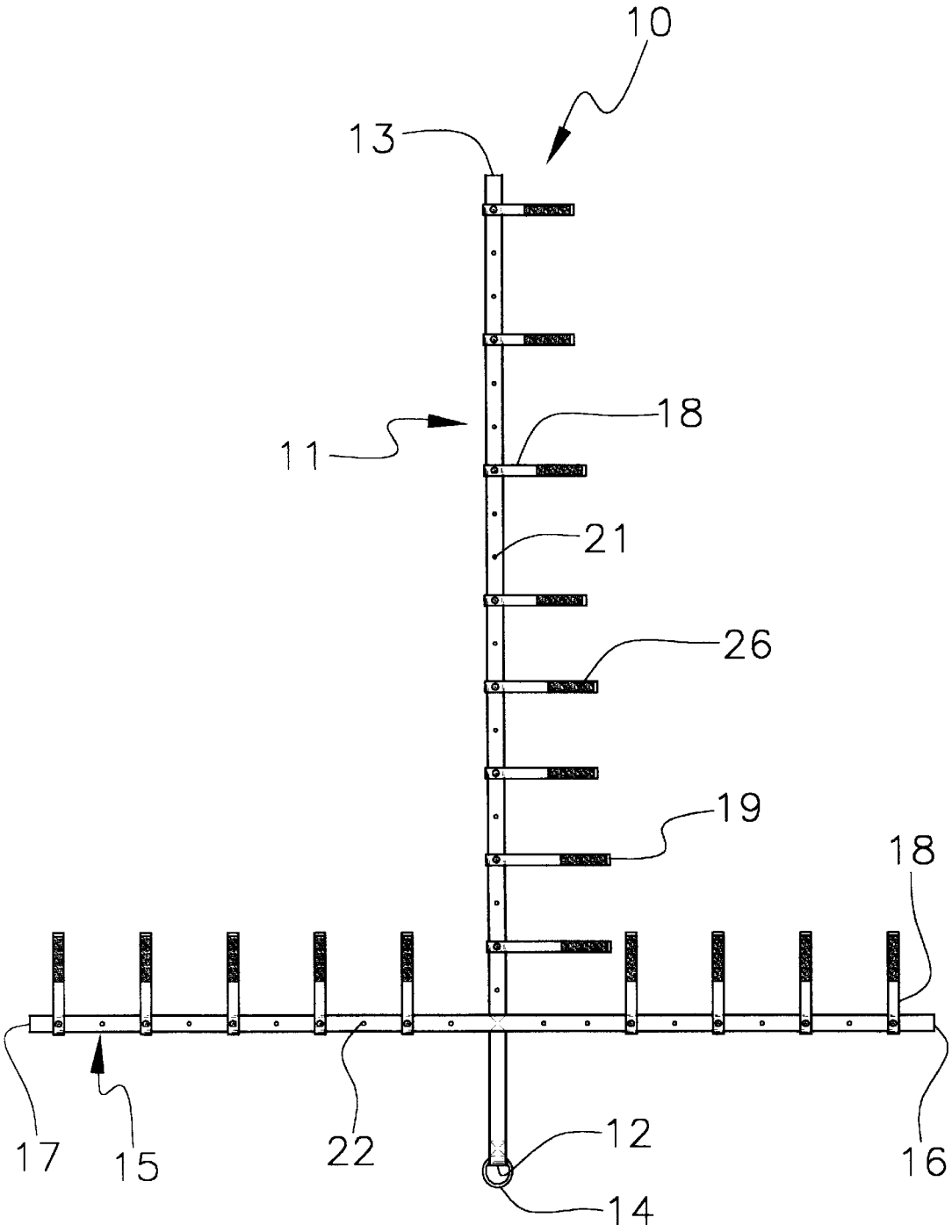
FIG. 1 is a schematic side view of a new sail banding device according to the present invention.
Figure 2:
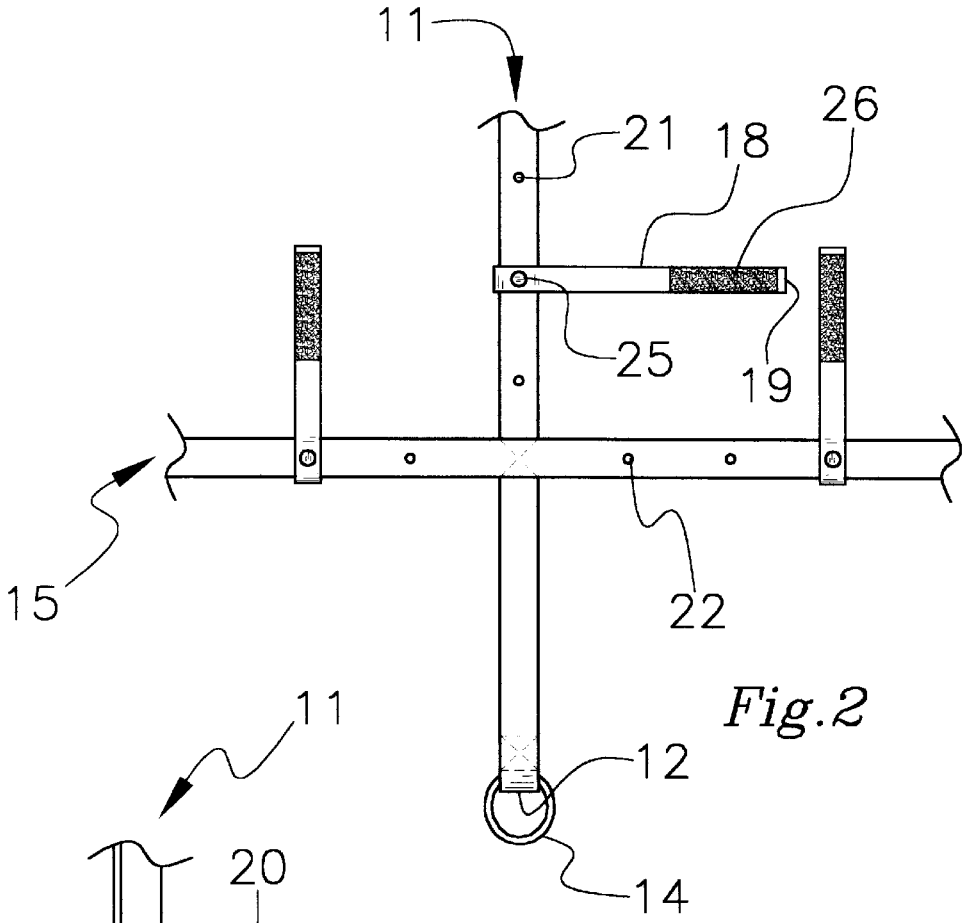
FIG. 2 is a schematic enlarged side view of the coupling between the first and second anchor straps of the present invention.

With reference now to the drawings, and in particular to FIGS. 1 through 4 thereof, a new sail banding device embodying the principles and concepts of the present invention and generally designated by the reference numeral 10 will be described.

As best illustrated in FIGS. 1 through 4, the sail banding device 10 generally comprises a pair of flexible elongate anchor straps coupled together. The anchor straps each have a plurality of flexible binding straps coupled thereto. Each of the binding straps is looped around the associated anchor strap in a generally U-shaped configuration such that the ends of each binding strap outwardly extends in a generally common direction from the associated anchor strap. The ends of each binding strap is detachably attached together.

In use, the sail banding device 10 is designed for preventing a furled sail, in particular a spinnaker, from filling until the sail is fully hoisted to help ensure a full and rapid fill regardless of the sea or wind conditions. In closer detail, the sail banding device comprises a flexible elongate first anchor strap 11 having a pair of opposite ends 12,13 and a longitudinal axis extending between the ends of first anchor strap. A first of the ends 12 of the first anchor strap has a shackle ring 14 coupled thereto. In use, the shackle ring is designed for securing the first end of the first anchor strap to a structure.

A flexible elongate second anchor strap 15 is provided having a pair of ends 16,17, and a longitudinal axis extending between the ends of the second anchor strap. The second anchor strap is coupled to the first anchor strap towards the first end of the first anchor strap. Ideally, the second anchor strap is coupled to the first anchor strap at a midpoint of the second anchor strap positioned generally equidistantly between the ends of the second anchor strap. The longitudinal axis of the second anchor strap is preferably extended substantially perpendicular to the longitudinal axis of the first anchor strap.

In use, the first anchor strap is designed for extending generally vertically along a furled sail while the second anchor strap is designed for extending generally horizontally along the furled sail.

The first and second anchor straps each has a plurality of flexible binding straps 18 coupled thereto. Each of the binding straps has a pair of opposite ends 19,20, and a midpoint generally equidistantly positioned between the ends of the respective binding strap. Each of the binding straps is coupled to the associated anchor strap adjacent the midpoint of the respective binding strap. Each of the binding straps is looped around the associated anchor strap in a generally U-shaped configuration such that the ends of each binding strap outwardly extend in a generally common direction from the associated anchor strap. In particular, as illustrated in FIG. 1, the binding straps of the second anchor strap are outwardly extended from the second anchor strap in a direction towards a second of the ends 13 of the first anchor strap. The binding straps of the first anchor strap are outwardly extended from the first anchor strap in a direction towards a first of the ends 16 of the second anchor strap.

Preferably, the first anchor strap has a plurality of spaced apart holes 21 therethrough. As illustrated in FIG. 1, the holes of the first anchor strap are arranged in a row extending between the second anchor strap and the second end of the first anchor strap. Similarly, the second anchor strap also has a plurality of spaced apart holes 22 therethrough. The holes of the second anchor strap are arranged in a pair of rows extending substantially parallel to the longitudinal axis of the second anchor strap. A first of the rows of holes of the second anchor strap is extended between the midpoint of the second anchor strap and the first end of the second anchor strap. A second of the rows of holes of the second anchor strap is extended between the midpoint of the second anchor strap and a second of the ends of the second anchor strap.

Preferably, the holes of each anchor strap are spaced apart at generally equal intervals in the respective row of holes. Ideally, the interval of each row of holes is about 1 inch.

Figure 3:
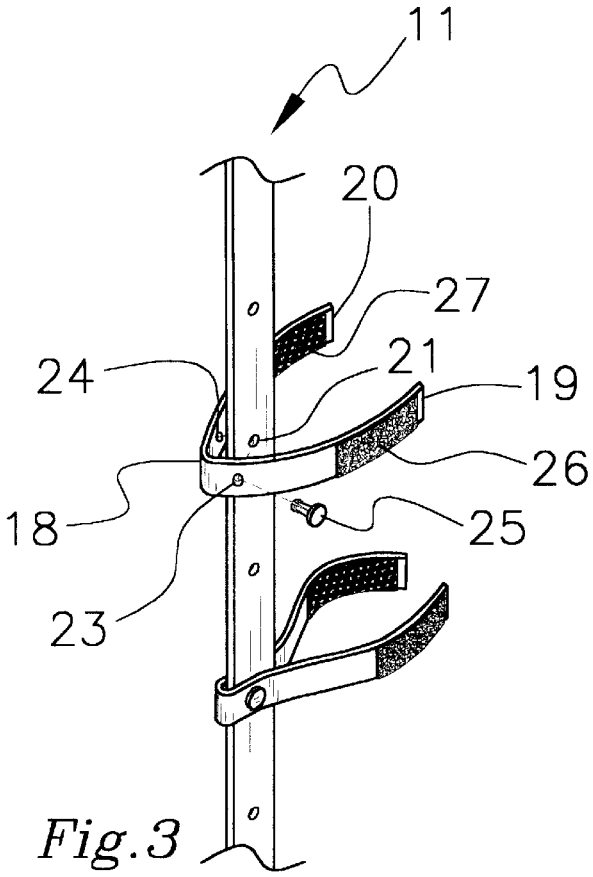
FIG. 3 is a schematic enlarged perspective view of a pair of binding straps of the present invention.
Figure 4:
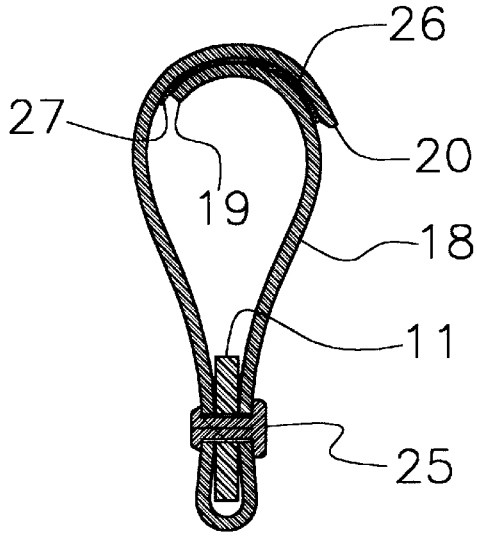
FIG. 4 is a schematic cross sectional view of a binding strap of the present invention.

Each of the binding straps has a pair of holes 23,24 adjacent the midpoint of the respective binding strap such that the midpoint of each binding strap is positioned interposed between the holes of the respective binding strap. With reference to FIGS. 3 and 4, each of the binding straps has a detachable fastener 25 such as a resilient plastic pop rivet extending through the holes of the respective binding strap and an associated hole of the associated anchor strap to detachably couple each binding strap to the associated anchor strap.

The ends of each binding strap are detachably attached together. Preferably, each binding strap has a hook and loop fastener detachably attaching the ends of the respective binding strap together. The hook and loop fastener of each binding strap has a pair of complementary portions 26,27 which are detachably attached together. One of the complementary portions is provided adjacent one end of the respective binding strap while the other complementary portion is provided adjacent the other end of the respective binding strap.

In use, the binding straps are designed for wrapping around a furled sail to prevent the furled sail from unfurling until fully hoisted. Preferably, the binding straps of the first anchor strap are designed for wrapping around a generally vertical portion of the furled sail while the binding straps of the second anchor strap are designed for wrapping around a generally horizontal portion of the furled sail positioned below the generally vertical portion of the furled sail.

As best illustrated in FIG. 1, in an ideal embodiment, the binding straps of the first anchor strap each have a length defined between the ends of the respective strap. Each of the binding straps of the first anchor strap has a length greater than the length of the adjacent binding strap of the first anchor strap positioned towards the first end of the first end of the first anchor strap with respect to the former binding strap and a length less than the length of the adjacent binding strap of the first anchor strap positioned towards the second end of the first end of the first anchor strap with respect to the former binding strap. In this ideal embodiment, the lengths of the binding straps of the second anchor straps are about equal to one another.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sail banding device for preventing a furled sail from filling until fully hoisted, said sail banding device comprising:

a flexible elongate first anchor strap having a pair of opposite ends and a longitudinal axis extending between said ends of first anchor strap;

a flexible elongate second anchor strap having a pair of ends, and a longitudinal axis extending between said ends of said second anchor strap;

said second anchor strap being coupled to said first anchor strap towards a first of said ends of said first anchor strap;

said first and second anchor straps each having a plurality of flexible binding straps coupled thereto;

each of said binding straps having a pair of opposite ends, and a midpoint generally equidistantly positioned between said ends of the respective binding strap;

each of said binding straps being looped around the associated anchor strap in a generally U-shaped configuration such that said ends of each binding strap outwardly extends in a generally common direction from the associated anchor strap; and said ends of each binding strap being detachably attached together.

2. The sail banding device of claim 1, wherein said first end of said first anchor strap having a shackle ring coupled thereto.

3. The sail banding device of claim 1, wherein said second anchor strap has a midpoint positioned generally equidistantly between said ends of said second anchor strap, wherein said second anchor strap is coupled to said first anchor strap at said midpoint of said second anchor strap.

4. The sail banding device of claim 1, wherein said longitudinal axis of said second anchor strap is extended substantially perpendicular to said longitudinal axis of said first anchor strap.

5. The sail banding device wherein said first anchor strap has plurality of spaced apart holes therethrough, said second anchor strap having a plurality of spaced apart holes therethrough, said holes of said second anchor strap being arranged in a pair of rows extending substantially parallel to said longitudinal axis of said second anchor strap, wherein each of said binding straps has a pair of holes, wherein each of said binding straps has a detachable fastener extending through said holes of the respective binding strap and an associated hole of the associated anchor strap to detachably couple each binding strap to the associated anchor strap.

6. The sail banding device of claim 1, wherein each binding strap has a hook and loop fastener detachably attaching said ends of the respective binding strap together.

7. A sail banding device for preventing a furled sail from filling until fully hoisted, said sail banding device comprising:

a flexible elongate first anchor strap having a pair of opposite ends and a longitudinal axis extending between said ends of first anchor strap;

a first of said ends of said first anchor strap having a shackle ring coupled thereto;

a flexible elongate second anchor strap having a pair of ends, and a longitudinal axis extending between said ends of said second anchor strap;

said second anchor strap being coupled to said first anchor strap towards said first end of said first anchor strap;

said second anchor strap having a midpoint positioned generally equidistantly between said ends of said second anchor strap, wherein said second anchor strap is coupled to said first anchor strap at said midpoint of said second anchor strap;

said longitudinal axis of said second anchor strap being extended substantially perpendicular to said longitudinal axis of said first anchor strap;

said first anchor strap being adapted for extending generally vertically along a furled sail, said second anchor strap being adapted for extending generally horizontally along the furled sail;

said first and second anchor straps each having a plurality of flexible binding straps coupled thereto;

each of said binding straps having a pair of opposite ends, and a midpoint generally equidistantly positioned between said ends of the respective binding strap;

each of said binding straps being coupled to the associated anchor strap adjacent the midpoint of the respective binding strap;

each of said binding straps being looped around the associated anchor strap in a generally U-shaped configuration such that said ends of each binding strap outwardly extends in a generally common direction from the associated anchor strap;

said binding straps of said second anchor strap being outwardly extended from said second anchor strap in a direction towards a second of said ends of said first anchor strap;

said binding straps of said first anchor strap being outwardly extended from said first anchor strap in a direction towards a first of said ends of said second anchor strap;

said first anchor strap having a plurality of spaced apart holes therethrough, said holes of said first anchor strap being arranged in a row extending between said second anchor strap and said second end of said first anchor strap;

said second anchor strap having a plurality of spaced apart holes therethrough, said holes of said second anchor strap being arranged in a pair of rows extending substantially parallel to said longitudinal axis of said second anchor strap;

a first of said row of holes of said second anchor strap being extended between said midpoint of said second anchor strap and said first end of said second anchor strap, a second of said row of holes of said second anchor strap being extended between said midpoint of said second anchor strap and a second of said ends of said second anchor strap;

wherein said holes of each anchor strap are spaced apart at generally equal intervals in the respective row of holes;

each of said binding straps having a pair of holes adjacent said midpoint of the respective binding strap such that said midpoint of each binding strap is positioned interposed between said holes of the respective binding strap;

each of said binding straps having a detachable fastener extending through said holes of the respective binding strap and an associated hole of the associated anchor strap to detachably couple each binding strap to the associated anchor strap;

said ends of each binding strap being detachably attached together, wherein each binding strap has a hook and loop fastener detachably attaching said ends of the respective binding strap together;

said binding straps being adapted for wrapping around a furled sail to prevent the furled sail from unfurling until fully hoisted, said binding straps of said first anchor strap being adapted for wrapping around a generally vertical portion of the furled sail, said binding straps of said second anchor strap being adapted for wrapping around a generally horizontal portion of the furled sail positioned below the generally vertical portion of the furled sail;

said binding straps of said first anchor strap each having a length defined between said ends of the respective strap;

said each of said binding straps of said first anchor strap having a length greater than the length of the adjacent binding strap of the first anchor strap positioned towards said first end of the first end of said first anchor strap with respect to the former binding strap;

said each of said binding straps of said first anchor strap having a length less than the length of the adjacent binding strap of the first anchor strap positioned towards said second end of the first end of said first anchor strap with respect to the former binding strap; and said lengths of said binding straps of said second anchor straps being about equal to one another.

* * * * *